US012759684B2

(12) United States Patent
Lamat et al.

(10) Patent No.: US 12,759,684 B2
(45) Date of Patent: Oct. 13, 2026

(54) STRUCTURE FOR ACCOMMODATING A POD FOR A TRACTION KITE AND METHOD FOR THE TAKE-OFF AND LANDING OF A SUCH A POD

(71) Applicant: AIRSEAS, Nantes (FR)

(72) Inventors: Eric Lamat, Mons (FR); Stéphane Jan, Montgiscard (FR); Jean-Luc Haudebault, Francois (FR)

(73) Assignee: KAWASAKI KISEN KAISHA LTD, Tokyo (JP)

( * ) Notice: Subject to any disclaimer, the term of this patent is extended or adjusted under 35 U.S.C. 154(b) by 225 days.

(21) Appl. No.: 18/719,502

(22) PCT Filed: Dec. 2, 2022

(86) PCT No.: PCT/EP2022/084235
§ 371 (c)(1),
(2) Date: Jun. 13, 2024

(87) PCT Pub. No.: WO2023/110459
PCT Pub. Date: Jun. 22, 2023

(65) Prior Publication Data

US 2025/0136258 A1 May 1, 2025

(30) Foreign Application Priority Data

Dec. 14, 2021 (FR) ..... FR2113522

(51) Int. Cl.
*B63H 9/072* (2020.01)

(52) U.S. Cl.
CPC ..... *B63H 9/072* (2020.02)

(58) Field of Classification Search
CPC .. B63H 9/072; B63H 9/071; B63B 2035/009; Y02T 70/5236
See application file for complete search history.

(56) References Cited

U.S. PATENT DOCUMENTS

2025/0313321 A1* 10/2025 Fukagawa ..... B63H 9/069

FOREIGN PATENT DOCUMENTS

| | | | | |
|---|---|---|---|---|
| DE | 102015111224 | | 1/2017 | |
| DE | 102015111224 | A1 * | 1/2017 | ..... B63H 9/069 |
| JP | 2008512290 | A * | 4/2008 | ..... B63H 9/069 |
| WO | WO-2019141691 | A1 * | 7/2019 | ..... B63H 9/069 |

* cited by examiner

*Primary Examiner* — Justin M Benedik
(74) *Attorney, Agent, or Firm* — Defillo & Associates, Inc; Evelyn A. Defillo

(57) ABSTRACT

A structure (3) for accommodating a pod (7) for a traction kite connected by a line (5) to a vessel, this accommodating structure having a frame (3*a*), at least one pulley (3*b*) for connecting the line, this pulley being mounted on a chassis (3*d*), and a follower arm (3*c*) and a pod support (4). This pod support includes at least two plates (4*a*, 4*b*) one above the other, at least one deformable elastic return device for securing the plates and a device for guiding and catching the line, the support being connected to the frame by at least one righting arm (6) that is movable between a stowed position for the pod, a take-off position for the pod (7), a cruise position at a distance from the line, a position for catching the line and a landing position for the pod.

27 Claims, 10 Drawing Sheets

STRUCTURE FOR ACCOMMODATING A POD FOR A TRACTION KITE AND METHOD FOR THE TAKE-OFF AND LANDING OF A SUCH A POD

CROSS REFERENCE TO RELATED APPLICATION

This application is a national stage entry of PCT/EP2022084235 filed Dec. 2, 2022, under the International Convention and claiming priority over French Patent Application No. FR2113522 filed Dec. 14, 2021.

TECHNICAL FIELD

The invention relates to a mounting structure for a traction kite pod and a method for the take-off and landing of a traction kite pod using that mounting structure. A traction kite is conventionally adapted to be deployed and to generate a traction force because of the effect of the wind and to be folded in the following manner:

- when the kite is stowed, the pod is placed on its mounting structure which is itself fastened to a base platform,
- when the kite is deployed, the pod takes off with the kite and leaves its mounting structure,
- when the kite is folded, the pod lands on the mounting structure, and
- when the kite is folded, the pod is placed on the mounting structure.

Such traction kites are used for the propulsion of a vehicle—in particular a ship—or for any application benefitting from such a traction force such as for the production of electricity.

In the field of maritime transport in particular this traction kite is able to provide a ship with a main or complementary propulsion means. Such a ship is generally propelled by an engine powered with heavy fuel such as fuel oil that emits a large quantity of pollutants (sulfur oxides, nitrogen oxides and carbon dioxide). Assisting or replacing these polluting propulsion means by a traction kite makes it possible to reduce the consumption of hydrocarbons, to lower the emission of pollutants and to benefit from a clean and renewable source of energy.

PRIOR ART

The working principle of the traction kite is based on the deployment of a kite, the latter supplying a traction force once it has been deployed and inflated. Such a kite is conventionally linked to a pod that is connected by a traction cable called an umbilical to a platform on the vehicle. The pod generally carries control modules of the kite. When the kite is not deployed it is stowed with the pod and the umbilical in a common storage box.

The pod therefore accompanies the kite in particular when deploying and folding it. The pod is usually guided by an operative when it takes off during deployment and when it lands during folding. This guidance ensures that the line, the pod and the kite are not tangled when they are stowed in the common storage box and exit from it.

These steps therefore necessitate human intervention and visual verification on each deployment/folding. Yet this human intervention limits the size of the pod and its content. Furthermore, a more complex pod including probes, beacons or other equipments required in the context of use of the kite becomes difficult for an operative to manipulate. Moreover a pod of this kind being stored under the kite in the storage box, it is inaccessible for carrying out maintenance on its equipments.

This pod also has the disadvantage of being permanently suspended throughout the deployment of the kite, which can impede its deployment by virtue of the additional mass that it has to support-the mass of the pod. Furthermore, the position of the pod is not fully controlled during all deployment and folding phases: the probability of risks of the pod colliding with the environment then increases significantly.

SUMMARY OF INVENTION

In order to remedy the disadvantages of the prior art explained hereinabove the main objective of the invention is to improve the control of the pod by means of variable positioning enabling the pod to be supported during deployment of the traction kite, to receive the pod during folding of the kite and to be retracted from the umbilical after the kite is launched, the pod thus adapting to movements of the kite and of the line.

To be more precise the present invention has for object a structure for mounting a pod of a kite connected by an umbilical to a ship. This structure includes a frame defining a horizontal plane, at least one pulley for connecting the umbilical installed on a chassis, and a follower arm and a pod support. The support includes:

- at least two stacked plates, a so-called lower plate below a so-called upper plate, the upper plate receiving the pod,
- at least one elastic and deformable return means for joining together the plates, and
- at least one means for guiding and catching the umbilical.

The support is connected to the frame by at least one erector arm fixed to the lower plate and mobile relative to the frame between at least one position for storing the pod, a position for the pod to take off, a cruising position at a distance from the umbilical, a position for catching the umbilical, and a position for landing the pod.

A multi-plate architecture fastened together by elastic return means advantageously makes it possible to accompany the movement of the pod before it takes off and to damp its landing. Accompaniment during take-off and landing therefore reduces the tensions in the umbilical and in the traction kite and helps to optimize the dimensions of these elements. Damping the pod during landing reduces the impact on contact between the pod and the support: the hardware contained in the pod is shaken less by this contact which reduces both the need for protection of this hardware and the overall mass of the pod.

The system for guiding and catching the umbilical integrated into the support advantageously makes it possible to guide the umbilical and therefore the pod into a position favorable to the reception and to the landing thereof with no need for manual guiding by an operative. Manual guiding by an operative is limited by the force that the latter is able to exert and consequently also limits the overall size and the mass of the pod. The guide means in accordance with the present invention should therefore make it possible to use pods of greater mass and overall size by limiting the risks associated with safety.

The support is advantageously mobile to follow the movements of the pod: the travel of the support adapts to that of the pod and once the latter is flying the support is retracted into a cruising position so as not to impede the movements of the umbilical and therefore of the kite where such impediment would reduce the efficacy of the kite.

In accordance with preferred embodiments, considered separately or in combination:

- the support is connected to the frame by two erector arms located on respective opposite sides of the drive pulley and fastened together at one of their ends by a transverse bar,
- the lower plate of the support is bolted to the transverse bar,
- the erector arms are mobile in rotation about an axis parallel to the horizontal plane and are actuated by at least one driving mechanism,
- the driving mechanism consists of cylinders,
- in the storage position the support is in a plane parallel to the horizontal plane and the umbilical is at an angle between 60° and 120° inclusive to the horizontal plane, the upper plate includes a means for centering the pod,
- the elastic and deformable return means consist of three springs to optimize the stabilization of the plates,
- the upper plate may tilt relative to the lower plate by an angle less than 30°,
- the guide and catching means return the umbilical from a maximum angle of 40° to a vertical axis perpendicular to the horizontal plane, the guide and catching means is integral with the lower plate,
- the guide and catching means is made of a plastic material such as DELRIN,
- the chassis of the connecting pulley is balanced and articulated laterally about an axis perpendicular to the rotation axis of the erector arms and parallel to the horizontal plane,
- at least one erector arm is equipped with a guide roller,
- The chassis of the connecting pulley includes at least one guide track facing each guide roller,
- the mounting structure includes sensors of the position of the erector arms, the chassis of the connecting pulley and the follow-up arm,
- at least one sensor of presence on the upper plate detects the presence of the pod, and
- at least one sensor on the lower plate in the vicinity of the elastic return means detects the position and the centering of the upper plate relative to the lower plate to lock the pod on the support in the storage position.

The invention also relates to a method for taking off and landing a pod of a kite on the support of a mounting structure. The pod taking off from the storage position includes the following steps:

- a step of tilting the support and the pod toward the take-off position,
- a step of deploying the kite,
- the pod taking off and paying out the umbilical, which extends in a field of movement, and
- tilting the support toward the cruising position until it is outside the field of movement of the umbilical.

Landing the pod to return it to the storage position includes the following steps:

- a step of lowering the kite and the pod by traction on the umbilical,
- a step of return tilting of the support, which enters the field of movement of the umbilical,
- catching and then centering the umbilical during the return tilting of the support, which progressively reduces the field of movement of the umbilical,
- return tilting the support into the landing position,
- landing the pod on the support, and
- a step of tilting toward the storage position.

Flying and landing the pod are advantageously dissociated from flying and folding the kite, respectively, thus making it possible to reduce the risks of tangling of the lines. Furthermore, in the storage position the pod is placed on its support which makes it accessible for maintenance operations.

During take-off the kinematic of tilting of the pod advantageously follows the alignment of the umbilical and therefore favors the flying of the kite by reducing the tension in the umbilical. During landing the step of catching and centering the umbilical makes the return of the pod safe by guiding the pod toward the support.

In accordance with preferred embodiments considered separately or in combination:

- take-off and landing of the pod are automated by localizing the tilting of the support, the follower arm and the connecting pulley and by controlling the tilting of the erector arms,
- The take-off position is reached when the tilting of the support induces an inclination of the umbilical to the horizontal plane by an angle between 70° and 80° inclusive,
- in the take-off position a step of tilting the pod relative to the support so that the pod follows the direction of the kite,
- in the cruising position the erector arms abut on the frame to retract the support from the field of movement of the umbilical that is included in a cone with a half-angle at the apex equal to 80° and with its axis perpendicular to the horizontal plane,
- during the catching step the field of movement of the umbilical is included in a cone with a half-angle at the apex equal to 20°,
- guiding and holding of the connecting pulley by the erector arms during the step of catching the umbilical to bring the pulley to a vertical position during landing,
- damping of the pod during landing on the support, and
- a step of tensioning the umbilical after detection of landing of the pod on the support to hold the pod on the support.

The method is advantageously automated and enables autonomous take-off and landing of the pod without intervention by an operative near the pod. Furthermore, the movements of the pod during landing are controlled—in particular when catching the umbilical—which improves safety in relation to these movements, in particular by reducing the risks of impacts in the environment near the pod and the mounting station.

BRIEF DESCRIPTION OF THE FIGURES

Other features and advantages of the present invention will emerge on reading the following detailed description with reference to the appended figures of one embodiment that does not limit the scope thereof, which figures represent.

DETAILED DESCRIPTION OF THE INVENTION

In the figures identical reference signs denote the same element and the corresponding passages in the description.

Figure 1:
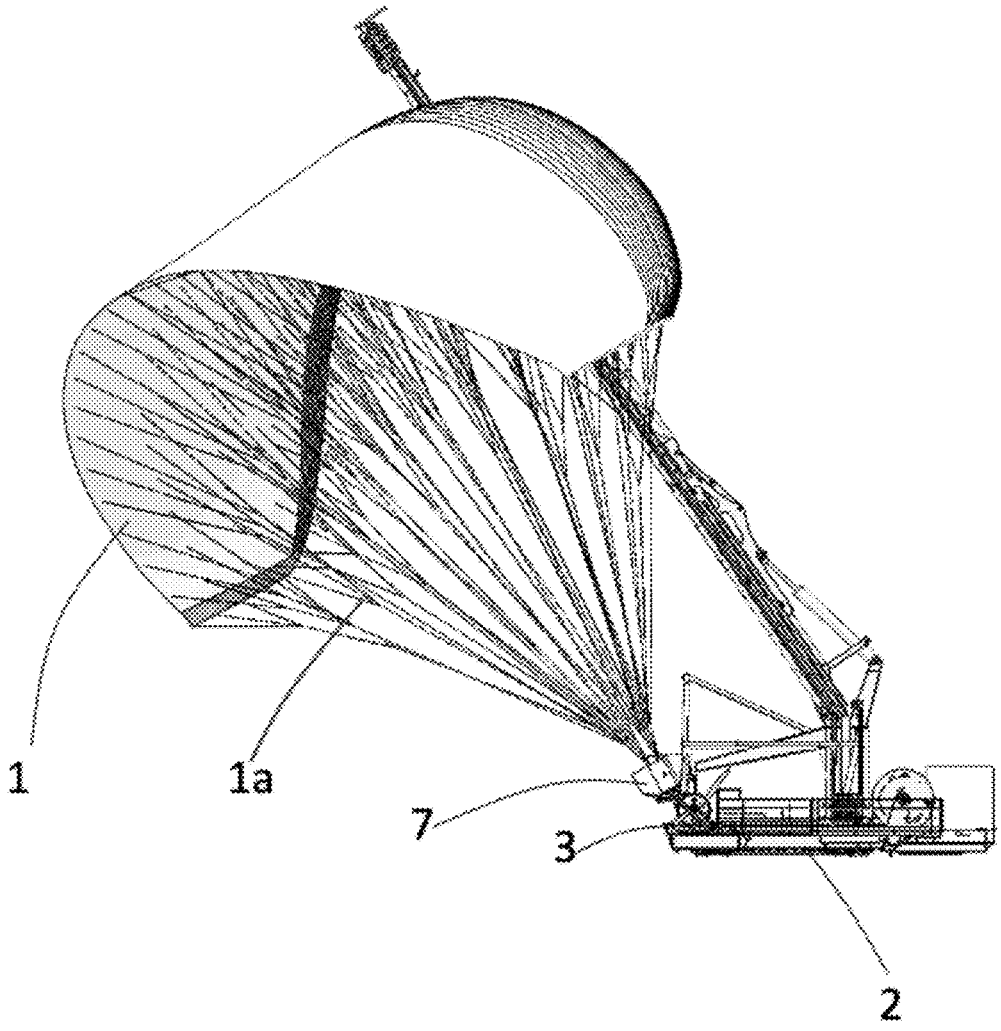
FIG. 1, a side view of the deployment of a traction kite.
Figure 2:
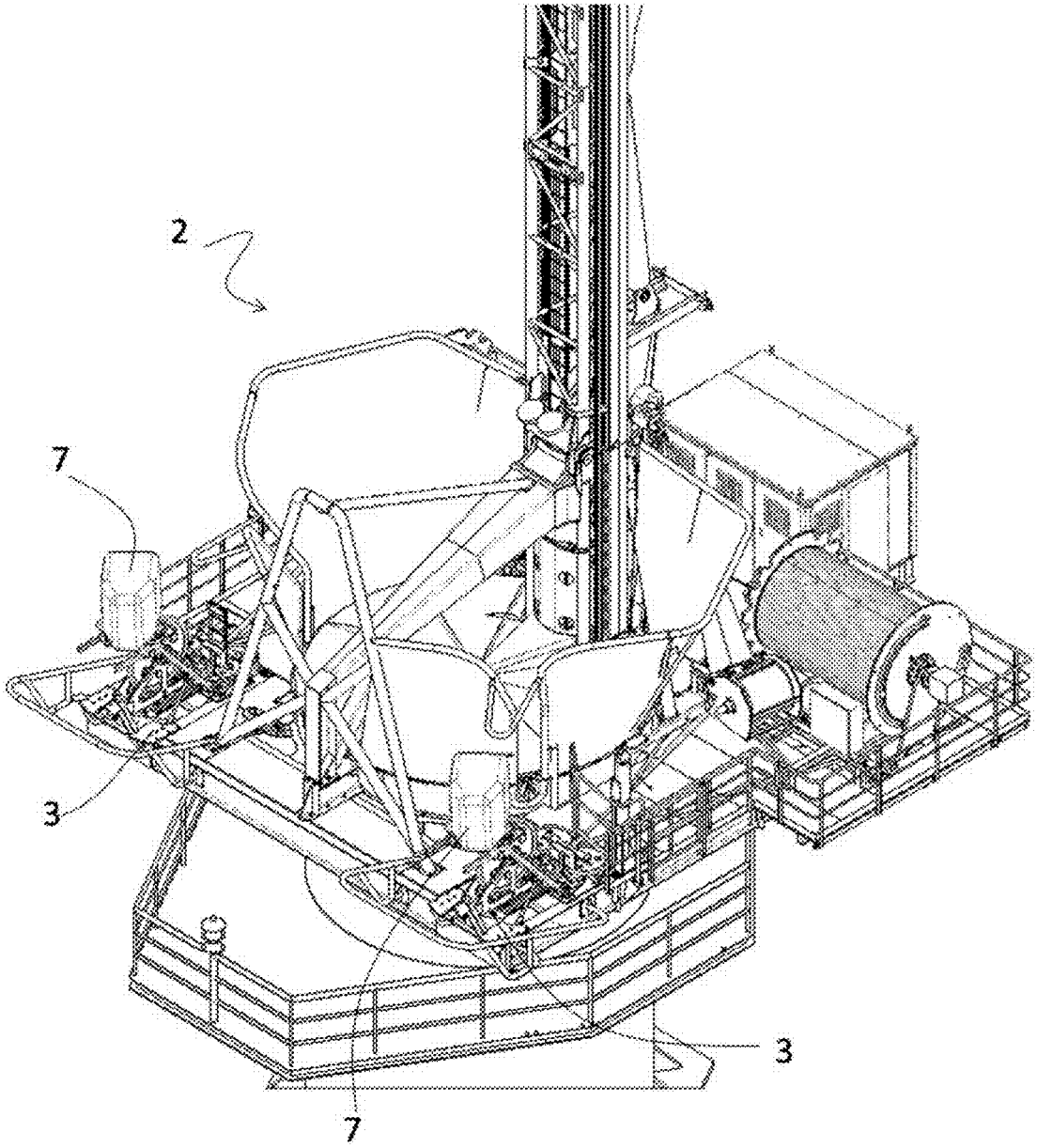
FIG. 2, a perspective view of a platform on which are disposed two mounting structures and two pods in storage positions, FIG. 3, a perspective view of the mounting structure with the pod in the storage position, FIG. 4*a*, a side view of the mounting structure in the storage position, FIG. 4*b*, a side view of the mounting structure in the storage position with the upper plate freed, FIG. 5, a side view of the mounting structure in the take-off position after tilting the upper plate of the support, FIG. 6, a side view of the mounting structure in the cruising position, FIG. 7, a side view of the mounting structure in the position for catching the umbilical, FIG. 8, a perspective view of the support, and FIG. 9, a flowchart of a method whereby the pod takes off from and lands on its support.

FIG. 1 depicts a traction kite 1 being deployed: it is connected to a pod 7 by a plurality of lines 1*a*. This pod 7 is placed on a mounting structure 3 disposed on a platform 2 on a ship (not represented). This platform, depicted in perspective in FIG. 2, carries two mounting structures 3 each carrying a pod 7.

Figure 3:
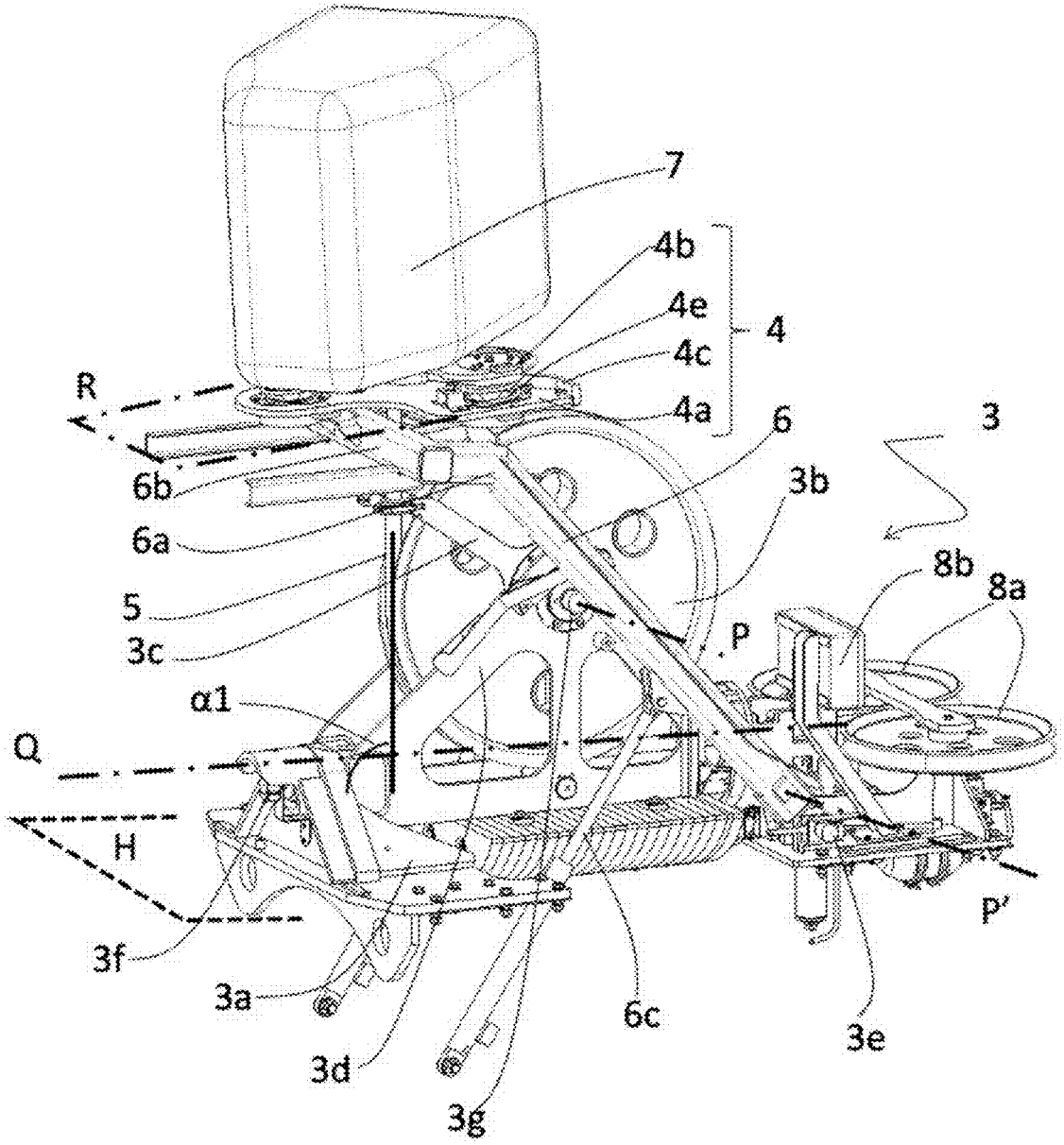

FIG. 3 is a perspective view of a mounting structure 3 of a pod 7 of a traction kite 1 of the ship, this pod 7 being connected to the ship by an umbilical 5. Here the mounting structure 3 is in the storage position of the pod 7 placed and held on said mounting structure 3. That structure includes:

- a frame 3*a* defining a horizontal plane H,
- a pulley 3*b* connecting the umbilical 5, installed on a chassis 3*d*,
- a follower arm 3*c* fixed to the driving pulley 3*b* to retain the umbilical 5 in the pulley 3*b*,
- a pod support 4,
- two secondary guide pulleys 8*a* oriented parallel to the horizontal plane H, and
- a guillotine 8*b* for cutting the umbilical in an emergency.

The support 4 includes:

- two stacked plates: a so-called lower plate 4*a* disposed under a so-called upper plate 4*b*, the latter receiving the pod 7,
- springs 4*e*—here three in number for stability reasons-these springs 4*e* connecting the plates 4*a*, 4*b* at their ends in order to constitute elastic and deformable return means for joining together the plate, and
- an edge 4*c* for guiding and catching the umbilical 5.

Furthermore, this support 4 is connected to the frame 3*a* by two erector arms 6 located on respective opposite sides of the connecting pulley 3*b* and connected at one of their ends 6*a* by a transverse bar 6*b* to which the lower plate 4*a* of the support 4 is bolted. These erector arms 6 are rotatable relative to the frame 3*a* about an axis P' parallel to the horizontal plane H: under these conditions the rotation of the erector arms 6 and consequently of the support 4 is aligned with the rotation of the connecting pulley 3*b* about an axis P and therefore with the direction of winding the umbilical 5. The chassis 3*d* is balanced and articulated laterally by an angle between −80° and +80° inclusive about an axis Q perpendicular to the rotation axis P' of the erector arms 6 and parallel to the horizontal plane H. This tilting movement contributes to the pulley 3*b* accompanying the umbilical 5.

Rotation of the erector arms 6 is actuated by two cylinders 6*c* that constitute driving mechanisms for placing the support 4 successively in the following positions:

- a pod 7 storage position,
- a pod 7 take-off position,
- a cruising position at a distance from the umbilical 5,
- a position for catching the umbilical 5, and
- a pod 7 landing position.

Other positions of the support can be envisaged as a function of requirements, in particular a maintenance position enabling easier access to the pod to carry out maintenance operations.

The mounting structure 4 includes position sensors: angular coders 3*e*, 3*f*, 3*g* for determining the angular positions of the erector arms 6, the chassis 3*d* of the connecting pulley 3*b* and the follower arm 3*c*, respectively. In this embodiment angular position sensors have been used: other types of position sensors such as proximity sensors may be used to determine the positions of the erector arms 6, the chassis 3*d* and the follower arm 3*c*.

In this storage position the umbilical 5 is at an angle □1 of 90° to the horizontal plane and the support 4 is in an inclined plane R. Alternatively, the support may be in a horizontal plane R and the umbilical 5 at an angle of 95° to the horizontal plane H defined parallel to the flotation plane of the water.

Figure 4A:
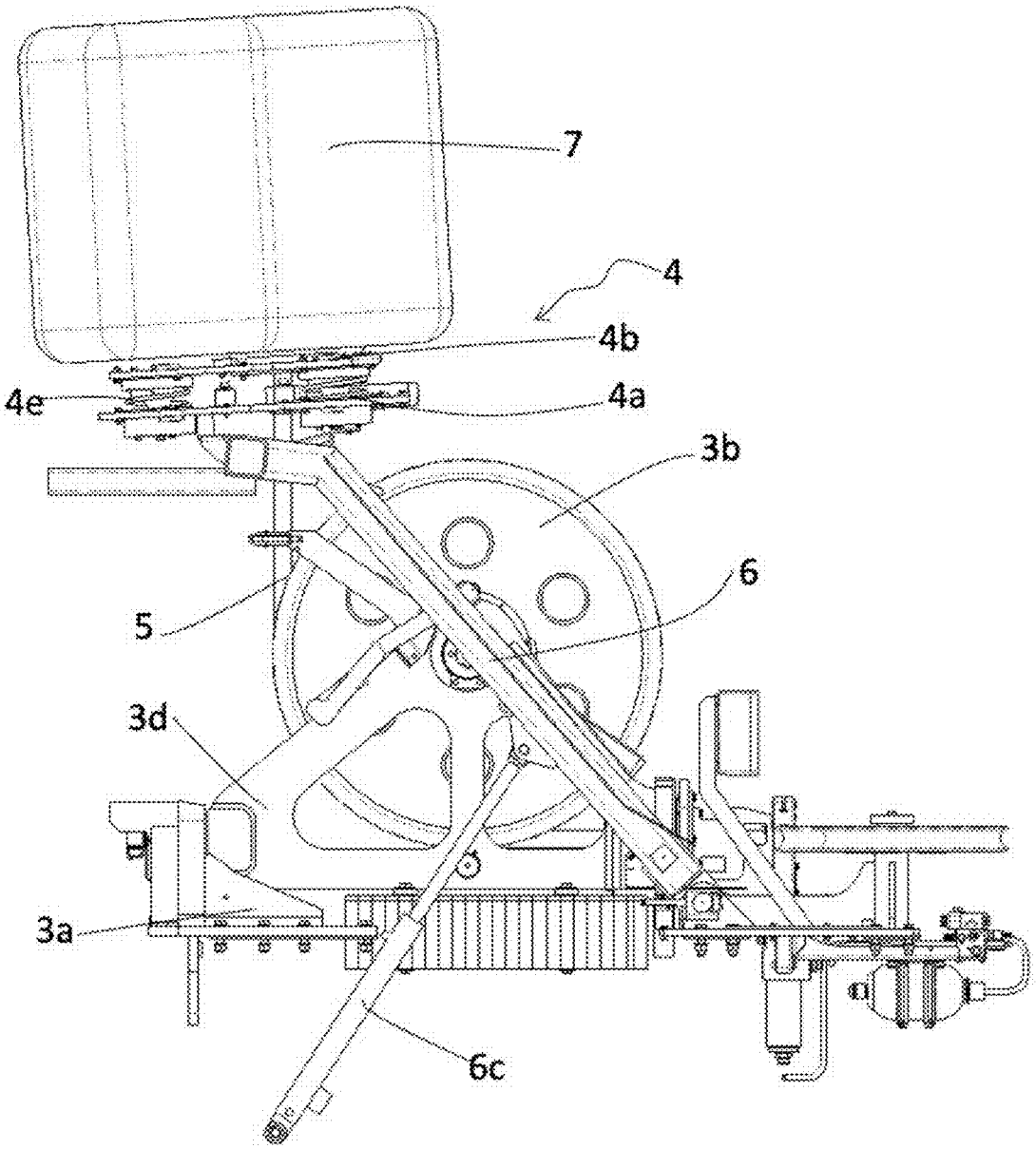
Figure 4B:
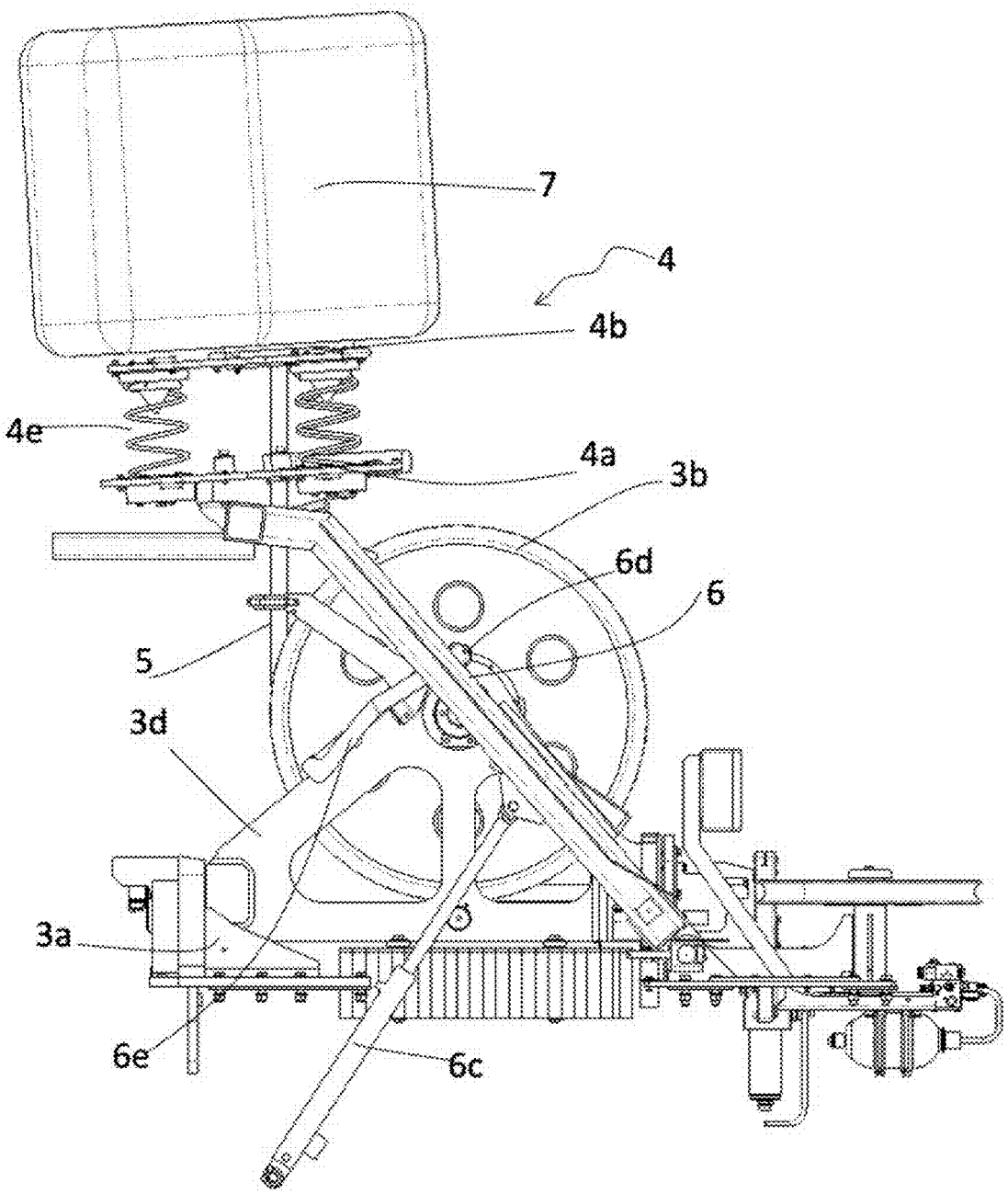

FIG. 4*a* and FIG. 4*b* show a side view of the storage/landing position of the support 4 before and after release of the upper panel 4*b* of the support 4. In FIG. 4*a* tension is exerted on the umbilical 5 which transmits that tension to the pod 7 on the support 4: the springs 4*e* are then compressed and the pod 7 is held on the support 4. In FIG. 4*b* this tension in the umbilical 5 has been released, enabling the springs 4*e* to exert their elastic return force to free the pod 7 from the support 4.

Figure 5:
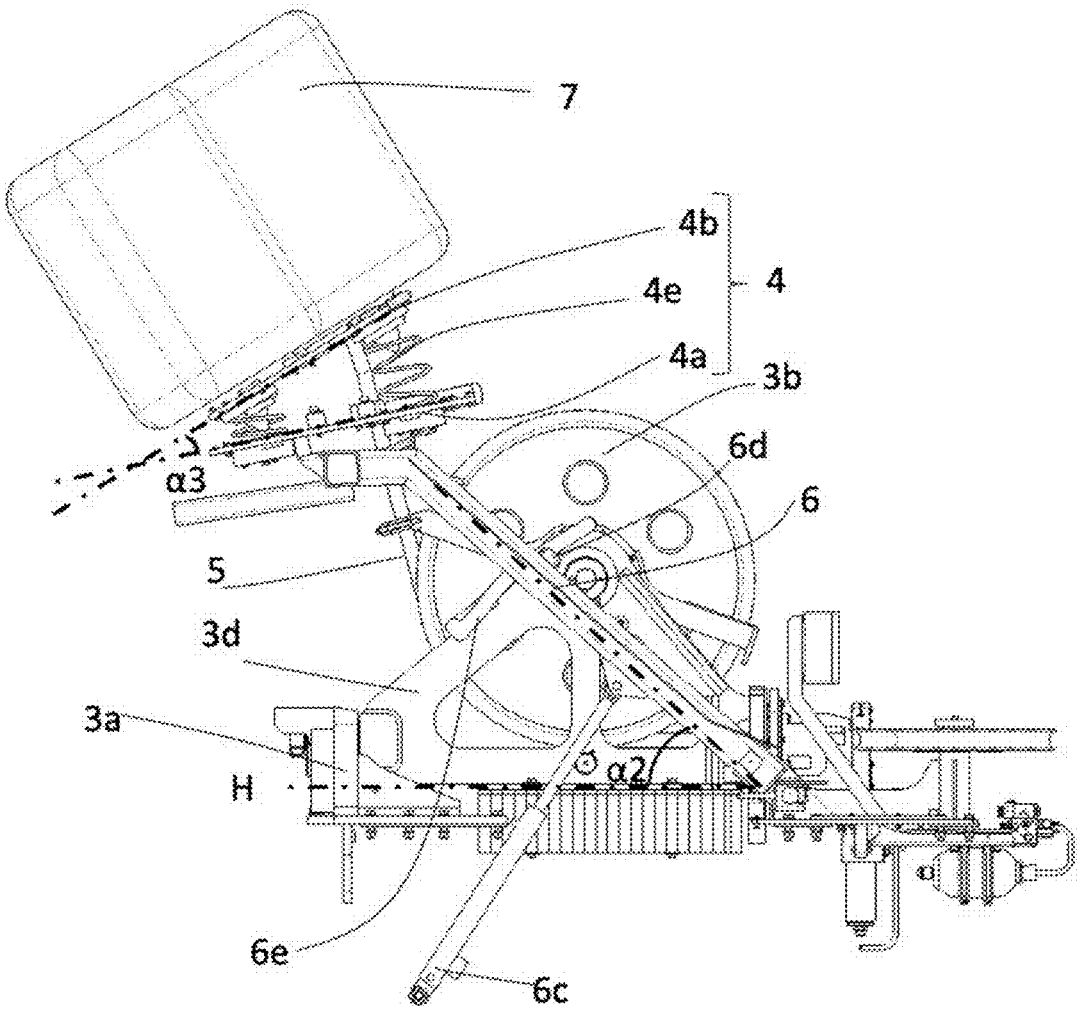

The take-off position of the support 4 is depicted in FIG. 5, the support 4 then being moved by rotation of the erector arms 6. This movement of the support 4 is controlled by means of the angular coders 3*e*: the latter are adapted as to determine the angular position of the erector arms 6 and therefore the position of the support 4. In this embodiment this take-off position induces an inclination of the umbilical 5 at an angle □2 of 75° to the horizontal plane H. During this movement of the support 4 gravity and the tension in the umbilical 5 hold the pod 7 in equilibrium on the upper plate of the support.

When the support 4 is in the take-off position the kite 1 is unfolded and ready to fly: the kite 1 then constitutes a traction sail that will pull on the pod 7. The latter is loaded on the one hand by the traction sail and on the other hand by the umbilical 5 under tension: the elastic nature of the springs 4*e* connecting the two plates 4*a*, 4*b* enables the upper plate 4*b* to tilt relative to the lower plate 4*a* to accompany the movement of the kite relative to the ship, the aforementioned angle □3 being less than 30°.

Figure 6:
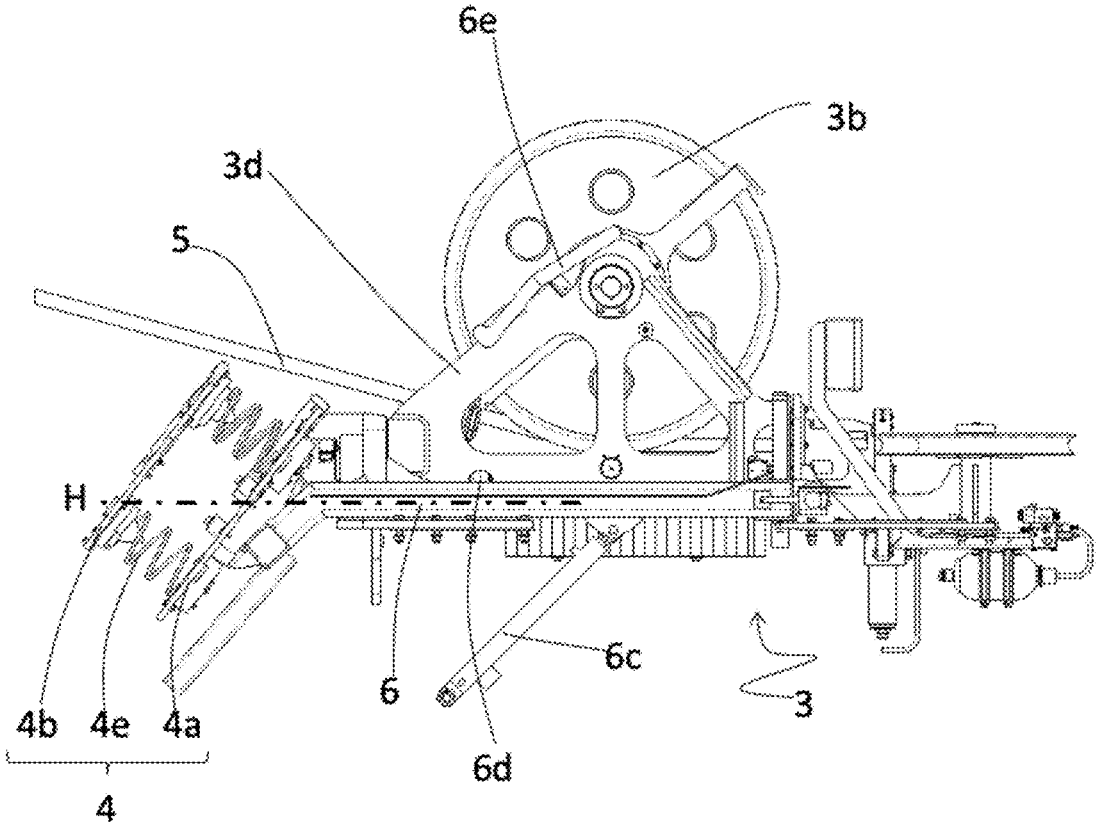

The cruising position of the support 4 is shown in FIG. 6 in which the erector arms 6 come to abut on the mounting structure 3 and are aligned on the horizontal plane H. This configuration of the erector arms 6 and the support 4 enables the support 4 to be distanced from the field of movement of the umbilical 5 so as not to impede its movement, which could reduce the efficacy of the kite 1.

Figure 7:
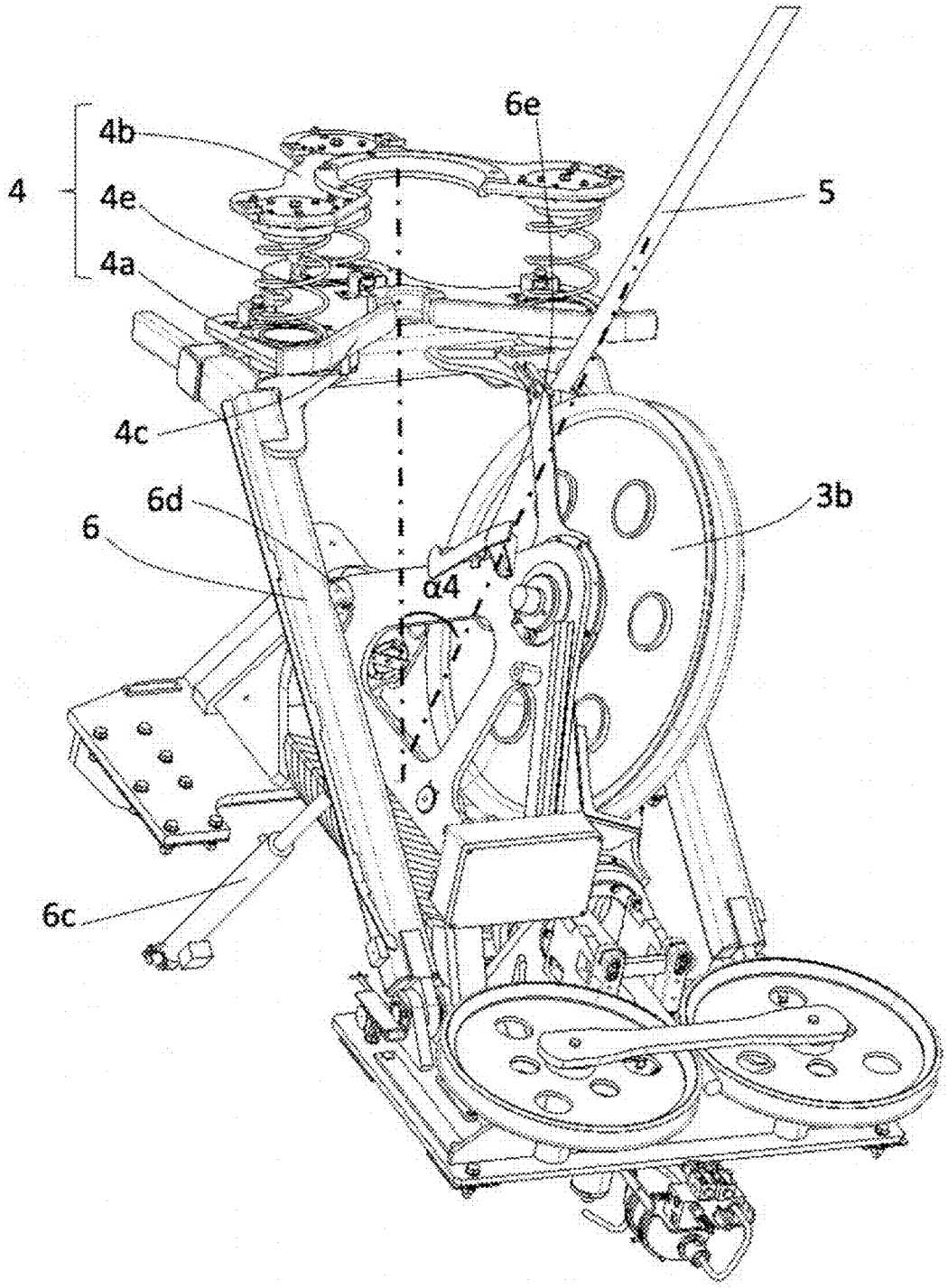

The FIG. 7 perspective view from the rear depicts the support 4 in the position for catching the umbilical 5. During erection the erector arms 6 rise from the cruising position to an intermediate position between the cruising position and the storage position: the umbilical 5 is close to vertical. The combination of the sensors 3*e*, 3*f*, 3*g* on the chassis 3*d*, the follower arm 3*c* and the erector arms 6 enables optimum positioning of the support 4 so that the lower plate 4*a* enters the field of movement of the umbilical 5 in a vertical position.

The support 4 includes an edge 4*c* for guiding and catching the umbilical 5 which returns it from a maximum angle □4 of 40° to a vertical axis perpendicular to the horizontal plane H. This guide edge 4*c* is integral with the lower plate 4*a* because that plate is closest to the umbilical 5 but in variant embodiments it could equally well be integrated into the upper plate 4*b* or both plates.

Each of the erector arms 6 is equipped with a guide roller 6*d*, the chassis 3*d* of the connecting pulley 3*b* including a guide track 6*e* facing guide roller 6*d*. When catching the umbilical this connection, also seen in FIG. 4*b* and FIG. 5, enables guiding and vertical orientation of the connecting pulley 3*b* to favor landing the pod 7.

Figure 8:
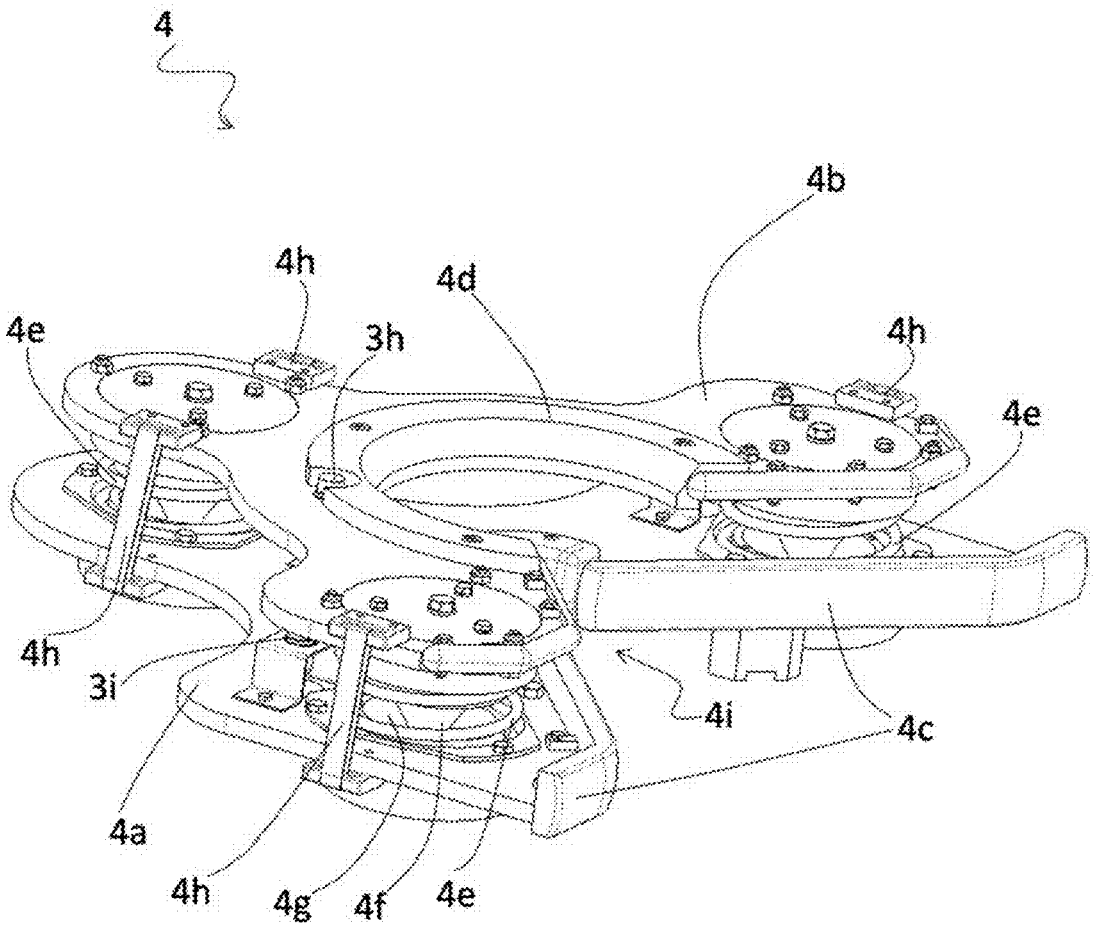

The FIG. 8 perspective view shows in detail the components of the support 4: the lower plate 4*a* and the upper plate 4*b* are connected by the three coil springs 4*e*. The lower plate 4*a* integrates the guide edge 4*c* made of a plastic material, for example DELRIN. The combination of the geometry of the edge 4*c* and the plastic material makes it possible to limit rubbing of the umbilical 5 on the lower plate 4*a* and therefore to reduce damage thereto when it is caught.

The support 4 and the erector arms 6 rise from the catching position: the umbilical 5 being in the field of the guide edge 4*c*, it is guided toward the center of the lower plate 4*a* that includes a catching notch 4*i*. Other means for guiding and catching the umbilical 5 may be used, such as a hooking mechanism or a magnetic assembly.

The upper plate 4*b* has an increased thickness 4*d* producing in conjunction with the pod 7 a centering means, the pod having a structure complementary to this increased thickness 4*d*. The circular geometry of the increased thickness 4*d* allows rotation of the pod 7 on the support 4 after centering. During landing the pod 7 is mechanically guided by this mechanical coupling that assures the stability of the pod 7 on the support 4. An induction type presence sensor 3*h* is advantageously installed on the upper plate 4*b* to detect the presence of the pod 7 and to command tensioning of the umbilical 5 after the pod lands, this tensioning enabling retention of the pod.

The support 4 includes on the lower plate 4*a* near the springs 4*e* three sensors 3*i* for detecting the position and centering of the upper plate 4*b* relative to the lower plate 4*a* and to lock the pod 7 on the support in the storage position by traction on the umbilical 5. In this embodiment the springs 4*e* are equipped with a centering finger 4*f* at one of their ends and a centering cone 4*g*—complementary to the centering finger—at their other end: this system localized in each of the three springs 4*e* centers the upper plate 4*b* on the lower plate 4*a*. Furthermore, four retaining straps 4*h* positioned near the springs 4*e* assure complementary locking of the springs 4*e* and of the upper plate 4*b* on the lower plate 4*a* during maintenance phases for example. These retaining straps 4*h* enable release of the tension in the umbilical 5 while retaining the support 4 in the storage position. The number and the position of these retaining straps 4*h* are variable and adjustable as a function of the requirements of the support 4.

All of the sensors are connected to a control system of the mounting structure 3 enabling the system to control and slave the positions of the erector arms 6 and of the support 4 dynamically during the various phases of using the kite 1 and its pod 7.

Figure 9:
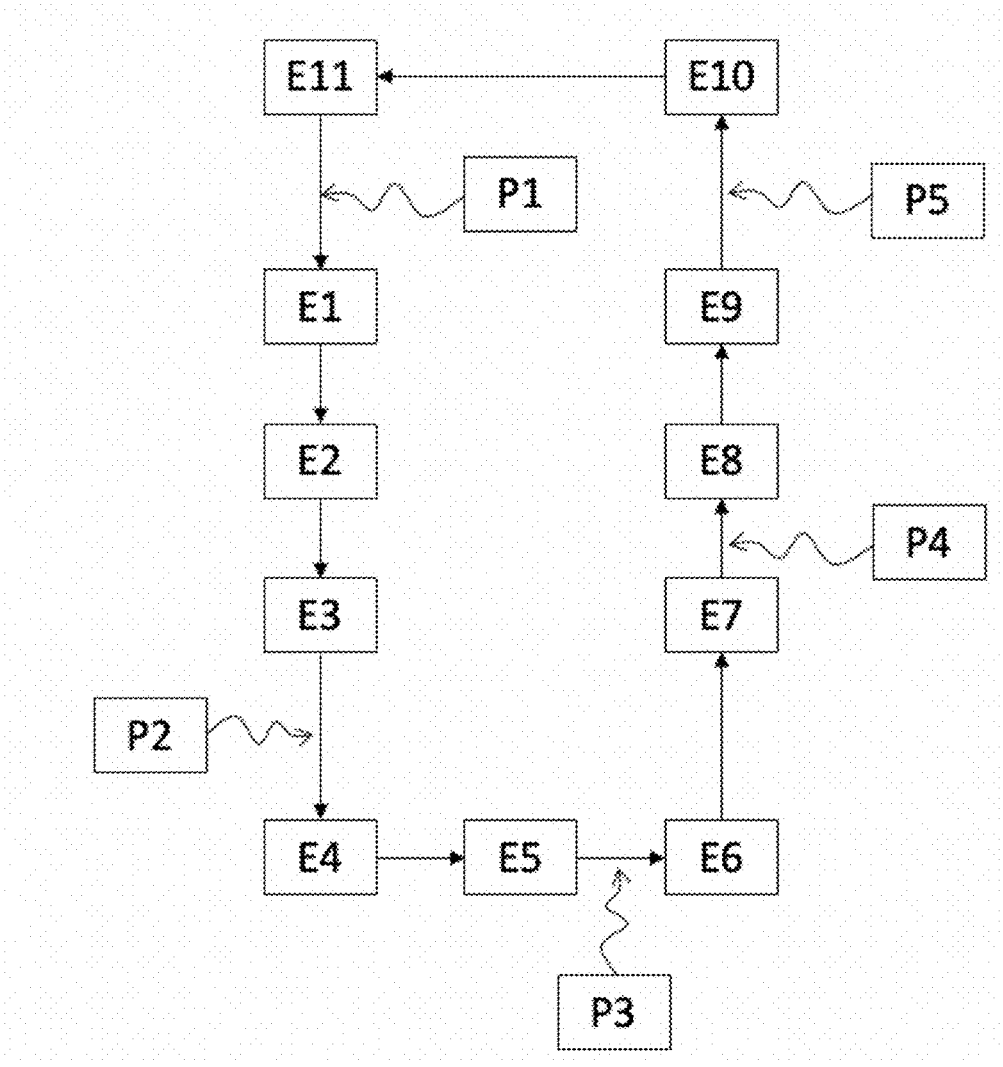

The FIG. 9 flowchart shows the following steps of one example of a method whereby the pod 7 takes off in a manner that is automated by the localization of the tilting of the support 4, the follower arms 3*c* and the connecting pulley 3*b* and by controlling the tilting of the erector arms 6 from the storage position P1:

- a step E1 of tilting the support 4 and the pod 7 toward the take-off position as far as an inclination of the umbilical 5 at an angle equal to 75° to the horizontal plane,
- a step E2 of deploying the kite and releasing the upper plate 4*b*,
- a step E3 of tilting the pod 7 relative to the support 4 toward a take-off position P2 so that the pod 7 follows the direction of the kite 1,
- a step E4 of the pod 7 taking off and of paying out the umbilical 5, which extends in a movement field, and
- a step E5 of tilting the support 4 toward the cruising position P3 until it is outside the field of movement of the umbilical 5, the erector arms 6 coming to abut on the frame to retract the support from the field of movement of the umbilical that is included in a cone with a half-angle at the apex equal to 80° and with its axis perpendicular to the horizontal plane.

The FIG. 9 diagram also shows in detail the steps of one example of a method of landing the pod in a manner automated by the localization of the tilting of the support 4, the follower arm 3*c* and the connecting pulley 3*b* and by control of the tilting of the erector arms 6 from the cruising position P3:

- a step E6 of lowering the kite 1 and the pod 7 by traction on the umbilical 5,
- a step E7 of return tilting of the support 4, which enters the field of movement of the umbilical 5 in the catching position P4,
- a step E8 of catching and then centering the umbilical 5 during the return tilting of the support 4 that progressively reduces the field of movement of the umbilical 5 that is included in a cone with a half-angle at the apex equal to 20°,
- a step E9 of return tilting of the support 4 to its landing position P5,
- a step E10 of landing and damping the pod 7 on the support 4 and tensioning the umbilical 5 after detection of the pod 7 landing on the support 4 to hold it there, and a step E11 of tilting toward the storage position P1.

During the umbilical catching step E8 the erector arms 6 guide and retain the connecting pulley 3*b* to render it vertical in the landing position P4.

The invention is not limited to the embodiments described and represented. Thus the support may be fastened to the erector arms by any means such as welding, gluing and riveting. The elastic return means between the plates of the support may consist of leaf springs or a layer of elastic material.

Furthermore, the erector arms may relative to the frame of the mounting structure follow a translation, circular translation or any other kind of translation kinematic to enable the support to adopt storage, take-off, cruising and catching positions, the drive mechanism then consisting of belts, links or drive shafts.

The invention may equally be combined with itself to use a plurality of traction kites 1 on a ship or to generate energy.

The invention claimed is:

1. A mounting structure (3) for a pod (7) of a kite (1) connected by an umbilical (5) to a ship, the mounting structure (3) comprising:

- a frame (3*a*) defining a horizontal plane (H),
- at least one pulley (3*b*) for connecting the umbilical (5), the connecting pulley (3*b*) being installed on a chassis (3*d*),
- a follower arm (3*c*), and
- a support (4) of the pod (7),
- at least two stacked plates, a so-called lower plate (4*a*) below a upper plate (4*b*), the upper plate (4*b*) receiving the pod (7),
- at least one elastic and deformatble return for joining together the plates (4*a*, 4*b*), and at least one guiding device for guiding and catching the umbilical (5), wherein the support (4) is connected to the frame (3*a*) by at least one erector arm (6) fixed to the lower plate (4*a*) and mobile relative to the frame (3*a*) between a position (P1) for storing the pod (7), a position (P2) for the pod (7) to take off, a cruising position (P3) at a distance from the umbilical (5), a position (P4) for catching the umbilical (5), and a position (P5) for landing the pod (7).

2. The mounting structure (3) as claimed in claim 1. wherein the support (4) is connected by two erector arms (6) located on respective opposite sides of the drive pulley (3*b*) and fastened together at one of their ends (6*a*) by a transverse bar (6*b*).

3. The mounting structure (3) as claimed claim 2, wherein the lower plate (4*a*) of the support (4) is bolted to the transverse bar (6*b*).

4. The mounting structure (3) as claimed in claim 1, wherein the erector arms (6) are mobile in rotation about an axis (P') parallel to the horizontal plane (H) and are actuated by at least one drive mechanism.

5. The mounting structure (3) as claimed in claim 4, wherein the drive mechanism consists of cylinders (6*c*).

6. The mounting structure (3) as claimed in claims 1, wherein in the storage position the support (4) is in a plane parallel to the horizontal plane (H) and the umbilical (5) is at an angle between 60° and 120° inclusive to the horizontal plane (H).

7. The mounting structure (3) as claimed in claim 1, wherein the upper plate (4*b*) includes a centering for centering the pod (7).

8. The mounting structure (3) as claimed in claim 1 wherein the elastic and deformable return device includes three springs (4*e*).

9. The mounting structure (3) as claimed in claim 1, wherein the upper plate (4*b*) tilts relative to the lower plate (4*a*) by an angle less than 30°.

10. The mounting structure (3) as claimed in claim 1, wherein the guide and catching device return the umbilical (5) from a maximum angle of 40° to a vertical axis perpendicular to the horizontal plane (H).

11. The mounting structure (3) as claimed in claim 1, wherein the guide and catching device is integral with the lower plate (4*a*).

12. The mounting structure (3) as claimed in claim 1, wherein the guide and catching means is made of a plastic material.

13. The mounting structure (3) as claimed in claim 1, wherein the chassis (3*d*) of the connecting pulley (3*b*) is balanced and articulated laterally about an axis (Q) perpendicular to the rotation axis of the erector arms and parallel to the horizontal plane (H).

14. The mounting structure (3) as claimed in claim 1, wherein the at least one erector arm (6) is equipped with a guide roller (6*d*).

15. The mounting structure (3) as claimed in the claim 14, wherein the chassis (3*d*) of the connecting pulley (3*b*) includes at least one guide track (6*e*) facing each guide roller (6*d*).

16. The mounting structure (3) as claimed in claims 1, wherein the mounting structure includes sensors of the position of the erector arms (6), the chassis (3*d*) of the connecting pulley (3*b*) and the follower arm (3*c*).

17. The mounting structure (3) as claimed in claim 1, wherein the mounting structure includes at least one presence sensor on the upper plate.

18. The mounting structure (3) as claimed in claims 1, wherein the lower plate (4*a*) includes at least one sensor (3*i*) in the vicinity of the elastic return device.

19. A take off and landing method for a pod (5) of a kite (1) on the mounting support (4) structure (3) as claimed in claims 1, wherein the pod (5) taking off from the storage position (P1) includes the following steps:

a step (E1) tilting the support (4) and the pod toward the take-off position (P2), a step (E2) deploying the kite (1), a step (E4) the pod (7) taking off and paying out the umbilical (5), which extends in a field of movement, and a step (E5) tilting the support (4) toward the cruising position (P3), and characterized in that landing the pod (7) includes the following steps:

a step (E6) lowering the kite (1) and the pod (7) by traction on the umbilical (5), a step (E7) of return tilting of the support (4), a step (E8) catching and then centering the umbilical (5) during the return tilting of the support (4), a step (E9) return tilting the support (4) into the landing position (P5), a step (E10) landing the pod (7) on the support (4), and a step (E11) tilting toward the storage position (P1).

20. The take-off and landing method as claimed in claim 19, wherein the step of take-off and landing of the pod (7) are automated by localizing the tilting of the support (4), the follower arm (3*c*) and the connecting pulley (3*b*) and by controlling the tilting of the erector arms (6).

21. The take-off and landing method as claimed in claim 19, wherein in the take-off position (P2) the angle of inclination of the umbilical (5) to the horizontal plane (H) is between 70° and 80° inclusive.

22. The take-off and landing method as claimed in claim 19, further comprising after the step (E2) a step (E3) of tilting the pod (7) relative to the support (4).

23. The take-off and landing method as claimed in claims 19, wherein in the cruising position (P3) the erector arms (6) abut on the frame (3*a*).

24. The take-off and landing method as claimed in claims 19, wherein the field of movement of the umbilical (5) during the catching step (E8) is included in a cone with a half-angle at the apex equal to 20°.

25. The take-off and landing method as claimed in claim 19, wherein during the step (E8) the erector arms (6) guide and retain the connecting pulley (3*b*).

26. The take-off and landing method as claimed in claim 19, wherein during the step (E10) the pod (7) is damped during landing on the support (4).

27. The take-off and landing method as claimed in claim 19, wherein during the step (E10) the umbilical (5) is tensioned after detection of landing of the pod (7) on the support (4).

* * * * *